US012044017B2

(12) United States Patent
Deifel et al.

(10) Patent No.: US 12,044,017 B2
(45) **Date of Patent: *Jul. 23, 2024**

(54) SELF-CLIMBING SYSTEM, SELF-CLIMBING UNIT AND METHOD FOR MOVING SUCH A SELF-CLIMBING UNIT ON A CONCRETE BUILDING STRUCTURE

(71) Applicant: PERI SE, Weissenhorn (DE)

(72) Inventors: Dieter Deifel, Blaustein (DE); Andre Zwerenz, Pfaffenhofen (DE)

(73) Assignee: PERI SE, Weissenhorn (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/839,111

(22) Filed: Jun. 13, 2022

(65) Prior Publication Data

US 2022/0307276 A1 Sep. 29, 2022

Related U.S. Application Data

(63) Continuation of application No. 16/092,208, filed as application No. PCT/EP2017/057795 on Apr. 3, 2017, now Pat. No. 11,359,390.

(30) Foreign Application Priority Data

Apr. 8, 2016 (DE) ..... 10 2016 205 956.4

(51) Int. Cl.
*E04G 11/28* (2006.01)

(52) U.S. Cl.
CPC ..... *E04G 11/28* (2013.01)

(58) Field of Classification Search
CPC ... E04G 11/20; E04G 11/28; E04G 2011/067; E04G 3/28; E04G 2003/286; E04G 11/24
See application file for complete search history.

(56) References Cited

U.S. PATENT DOCUMENTS 2,516,318 A * 7/1950 Hawes ..... E04G 11/22 182/147
3,472,477 A * 10/1969 Juhl ..... E04G 11/28 249/20
3,591,123 A * 7/1971 Edwards ..... E04G 11/28 249/20

(Continued)

FOREIGN PATENT DOCUMENTS

AT 504303 A2 * 4/2008 ..... E04G 11/22
CA 2870412 A1 * 5/2015 ..... E04G 11/28

(Continued)

*Primary Examiner* — Ryan D Kwiecinski
(74) *Attorney, Agent, or Firm* — SLEMAN & LUND LLP

(57) ABSTRACT

A self-climbing system with a self-climbing unit in which the climbing brackets and the working brackets each have anchor receptacles which each correspond with one another in their pattern with respect to their relative positions, with the result that, after freeing the anchor holes, which are used by the working brackets, of an anchor point of a concrete wall section of a concrete building structure, the climbing brackets can be anchored in precisely these freed anchor holes of the anchor point. Moreover, the invention relates to a self-climbing unit for an aforementioned self-climbing system and to a method for moving such a self-climbing unit on a concrete building structure.

20 Claims, 9 Drawing Sheets

(56) References Cited

U.S. PATENT DOCUMENTS 3,628,223 A * 12/1971 Babee ..... E04G 11/28 249/20
3,779,678 A * 12/1973 Scheller ..... E04G 11/22 425/DIG. 126
4,040,774 A * 8/1977 Scheller ..... E04G 11/28 254/338
4,060,358 A * 11/1977 Fougea ..... E04G 3/243 249/20
4,147,483 A * 4/1979 Rovera ..... E04G 11/28 249/20
4,290,576 A * 9/1981 Schworer ..... E04G 11/28 249/20
4,397,441 A * 8/1983 Manderla ..... E04G 17/002 249/19
4,530,648 A * 7/1985 Phillips ..... E04G 11/28 249/20
4,694,933 A * 9/1987 Sinko ..... E04G 3/24 182/128
4,917,346 A * 4/1990 Mathis ..... E04G 11/28 249/153
5,000,287 A * 3/1991 Schwoerer ..... E04G 11/28 182/136
5,088,263 A * 2/1992 Horii ..... E04G 21/242 52/745.13
5,630,482 A * 5/1997 Schworer ..... E04G 11/28 425/65
6,260,311 B1 * 7/2001 Vladikovic ..... E04G 11/28 52/114
6,557,817 B2 * 5/2003 Waldschmitt ..... E04G 11/28 249/19
7,513,480 B2 * 4/2009 Bergaretxe ..... E04G 11/28 249/20
7,938,380 B2 * 5/2011 Becker ..... E04G 17/16 249/20
8,673,189 B2 * 3/2014 Schwoerer ..... E04G 11/28 249/20
8,708,100 B2 * 4/2014 Schwoerer ..... E04G 11/28 182/20
9,175,487 B2 * 11/2015 Iturbe Beristain .... E04G 21/166
9,181,719 B2 * 11/2015 Jentsch ..... B28B 1/14
9,279,260 B2 * 3/2016 Baum ..... E04G 19/003
9,476,210 B2 * 10/2016 Urzelai Ezkibel ..... E04G 3/28
9,556,626 B2 * 1/2017 Mork ..... E04G 3/243
9,611,663 B2 * 4/2017 Baum ..... E04G 11/24
10,023,435 B2 * 7/2018 Taylor ..... B66B 11/0005
10,036,170 B2 * 7/2018 Panseri ..... E04G 11/28
10,077,564 B1 * 9/2018 Gruebler ..... E04G 19/003
10,428,536 B2 * 10/2019 Gardner ..... E04G 3/20
10,711,470 B2 * 7/2020 Vogl ..... E04G 11/32
10,914,083 B2 * 2/2021 Johnson ..... E04G 11/02
10,988,949 B2 * 4/2021 Puchner ..... E04G 21/3233
11,098,490 B2 * 8/2021 Baum ..... E04G 11/28
11,136,769 B2 * 10/2021 Zitting ..... E04G 21/0418
11,248,382 B1 * 2/2022 Magnusen ..... E04G 11/28
11,346,117 B2 * 5/2022 Faresin ..... E04G 21/3247
11,359,390 B2 * 6/2022 Deifel ..... E04G 11/28
11,408,188 B1 * 8/2022 Magnusen ..... E04G 11/34
11,549,272 B2 * 1/2023 Klaus ..... E04G 11/24
11,591,811 B2 * 2/2023 Amon ..... E04G 11/28
11,655,640 B2 * 5/2023 Abadia Perez ..... E04G 11/28 182/36
11,655,641 B2 * 5/2023 Liu ..... E04G 11/28 182/142
2002/0030293 A1 * 3/2002 Rock ..... E04G 11/28 264/33
2003/0052249 A1 * 3/2003 Waldschmitt ..... E04G 11/28 249/20
2007/0119116 A1 * 5/2007 Arozena Bergaretxe ..... E04G 11/28 52/633
2009/0041879 A1 * 2/2009 Baum ..... E04G 11/28 33/286
2009/0173574 A1 * 7/2009 Hobmeier ..... E04G 11/28 182/82
2010/0038518 A1 * 2/2010 Schwoerer ..... E04G 11/28 249/20
2011/0214824 A1 * 9/2011 Beristain ..... E04G 21/166 160/368.1
2013/0341813 A1 * 12/2013 Baum ..... E04G 11/28 264/33
2017/0254100 A1 * 9/2017 Baum ..... E04G 11/20
2018/0245357 A1 * 8/2018 Gruebler ..... E04G 11/28
2018/0320392 A1 * 11/2018 Gruebler ..... E04G 11/24
2019/0145111 A1 * 5/2019 Vogl ..... E04G 11/32 249/20
2022/0325541 A1 * 10/2022 Schmid ..... E04G 21/3247
2023/0392395 A1 * 12/2023 Schock ..... E04G 11/24

FOREIGN PATENT DOCUMENTS

CN 101492962 A 7/2009
CN 106401174 A * 2/2017 ..... E04G 11/28
CN 106836146 A * 6/2017 ..... E02B 7/12
CN 206680962 U * 11/2017
CN 108331335 A * 7/2018
CN 108590171 A * 9/2018
CN 108915251 A * 11/2018 ..... E01D 21/00
CN 109162203 A * 1/2019 ..... E01D 19/14
CN 109267494 A * 1/2019 ..... E01D 21/00
CN 109403622 A * 3/2019 ..... E04G 11/28
CN 109469319 A * 3/2019 ..... E04G 11/28
CN 208830717 U * 5/2019 ..... E01D 21/00
CN 209082956 U * 7/2019 ..... E04G 3/28
CN 110388048 A * 10/2019 ..... E04G 11/28
CN 110469105 A * 11/2019 ..... E04G 11/22
CN 110656802 A * 1/2020 ..... E04G 11/22
CN 110714611 A * 1/2020 ..... E04G 11/28
CN 212176540 U * 12/2020
CN 112390171 A * 2/2021
CN 113266145 A * 8/2021 ..... E04B 2/84
CN 214114729 U * 9/2021
CN 216405121 U * 4/2022
CN 216515141 U * 5/2022
CN 114673343 A * 6/2022
CN 114961228 A * 8/2022
CN 115030046 A * 9/2022
CN 115182269 A * 10/2022
CN 115182568 A * 10/2022
CN 115306135 A * 11/2022
CN 115637645 A * 1/2023
CN 115788012 A * 3/2023
CN 219080090 U * 5/2023
CN 116537071 A * 8/2023
CN 219527362 U * 8/2023
CN 116676873 A * 9/2023
CN 219972946 U * 11/2023
CN 220394299 U * 1/2024
DE 805312 C * 5/1951 ..... E04G 11/28
DE 870023 C * 3/1953 ..... E04G 11/28
DE 1908714 9/1970
DE 2402683 A1 * 7/1975 ..... E04G 11/28
DE 2921636 * 12/1980 ..... E04G 11/28
DE 3006491 A1 * 8/1981 ..... E04G 11/28
DE 19639038 6/1998
DE 102005030336 A1 1/2007
DE 102016205956 A1 * 10/2017 ..... E04G 11/28
DE 102018117727 A1 * 1/2020 ..... E04G 11/24
DE 102018123405 A1 * 3/2020 ..... E04G 17/002
EP 0373617 A2 * 6/1990 ..... E04G 11/28
EP 1944431 7/2008
EP 3241959 A1 * 11/2017 ..... E04G 5/046
FR 55947 E * 9/1952 ..... E04G 11/28
FR 2487410 A1 * 1/1982 ..... E04G 11/28
GB 1536014 A * 12/1978 ..... E04G 11/28
GB 2189831 A * 11/1987 ..... E04G 11/22
GB 2598124 A * 2/2022 ..... E04G 11/28
JP S63261064 A 10/1988
JP S6429573 A 1/1989
KR 2016148757 A * 12/2016 ..... E04G 11/24
KR 1793403 B1 * 11/2017 ..... E04G 11/24

(56) References Cited

FOREIGN PATENT DOCUMENTS

| | | | | | |
|---|---|---|---|---|---|
| KR | 2115380 | B1 | * | 5/2020 | ..... E02D 29/045 |
| WO | WO-9813565 | A1 | * | 4/1998 | ..... E04G 11/28 |
| WO | WO-2007000139 | A1 | * | 1/2007 | ..... E04G 11/28 |
| WO | WO-2007141264 | A1 | * | 12/2007 | ..... E04G 11/28 |
| WO | WO-2009117986 | A1 | * | 10/2009 | ..... E04B 1/3505 |
| WO | WO-2014062062 | A1 | * | 4/2014 | ..... E04G 11/22 |
| WO | WO-2020245185 | A1 | * | 12/2020 | ..... E04G 11/28 |
| WO | WO-2021196927 | A1 | * | 10/2021 | ..... E04G 11/28 |

* cited by examiner

SELF-CLIMBING SYSTEM, SELF-CLIMBING UNIT AND METHOD FOR MOVING SUCH A SELF-CLIMBING UNIT ON A CONCRETE BUILDING STRUCTURE

FIELD OF THE INVENTION

The invention relates to a self-climbing system, a self-climbing unit and a method for moving such a self-climbing unit on a concrete building.

BACKGROUND OF THE INVENTION

In construction, self-climbing units are used e.g. in the construction of vertically oriented concrete building structures, in particular so-called building cores, bridges, retaining walls and the like, as a self-climbing shuttering and/or self-climbing protective screen and/or in the form of self-climbing scaffolding units. The self-climbing units are usually provided with a working platform and can be moved without a crane from a lower finished concrete wall section of the concrete building structure to be created or finished to a further, higher-positioned hardened further concreting section of the concrete structure. For such a climbing or moving operation, lifting cylinders or so-called climbing cylinders are used which are usually hydraulically operated. The climbing cylinders are supported on so-called climbing brackets, which are anchored releasably in anchor points of a lower concrete wall section of the concrete building component. The working platform and, if necessary, the concrete shuttering elements to be used for shuttering work are themselves fastened or supported on so-called working brackets. The working brackets are anchored above the climbing brackets on the concrete building component. During the climbing process, the working brackets are first moved in the climbing or vertical direction up on the concrete building structure and are anchored in anchor points of the concrete building structure. Finally, the climbing brackets can be pulled upward in the climbing or vertical direction by means of the climbing cylinder and can be anchored in further anchor points on the concrete building structure. If the concrete building structure is oriented vertically, then the climbing direction coincides with the vertical, i.e. the vertical direction. In the case of a concrete building structure to be constructed that is arranged, at least in sections, obliquely to the vertical direction, such as in the case of a dam (retaining wall), the climbing direction deviates of course from the vertical direction accordingly.

For fastening, meaning for anchoring the working and climbing brackets in the concreting sections, anchor bolts are used. The anchor bolts are usually in the form of bolts. The anchor points are formed by concrete wall anchors that are embedded in concrete in the respective concreting sections of the concrete building component. Such concrete wall anchors must be arranged in the concrete wall sections at exactly predetermined positions and therefore collide regularly with the reinforcement steel that is to be embedded there. The reinforcement steel must therefore to some extent be tediously guided around the anchor points or possibly must be removed in the area of the anchor points before they are concreted. In general, this can lead to an undesirable structural weakening of the concrete building structure, in particular with a large number of anchor points. At the same time, the number of anchor points and, therefore, also of concrete wall anchors should be kept as low as possible for cost reasons.

SUMMARY OF THE INVENTION

It is therefore the object of the invention to provide a self-climbing system and a self-climbing unit which require less material and installation expense and in which the risk of structural weakening of the reinforcement of the concrete building structure by anchor points for the self-climbing unit is reduced. In addition, a simplified and less time-consuming method for moving an aforementioned self-climbing unit is to be specified.

The object concerning the self-climbing system is achieved by a self-climbing system and the object concerning the self-climbing unit is achieved by a self-climbing system.

The self-climbing system according to the invention comprises a first concrete wall section and a second concrete wall section that are arranged one above the other in the climbing or vertical direction. The self-climbing system includes a self-climbing unit comprising:

- Climbing brackets, each having first anchor receptacles for anchor bolts by means of which the climbing brackets can be releasably anchored in anchor holes of first anchor points of the first concrete wall section;
- Working brackets with second anchor receptacles for anchor bolts by means of which the working brackets can be releasably anchored in anchor holes of second anchor points of the second concrete wall section, in each case one of the first anchor points of the first concrete wall section and one of the second anchor points of the second concrete wall section being arranged in pairs to each other in the climbing or vertical direction;
- A working platform that is attachable to the working brackets;
- Climbing cylinders, which are fastened at one end to one of the climbing brackets and at the other end to one of the working brackets and by means of which the working brackets are movable from the second anchor points to third anchor points of a third concrete wall section of the concrete component adjacent to the second concrete wall section in the vertical/climbing direction above the second concrete wall section.

According to the invention, the first anchor receptacles of the climbing brackets and the second anchor receptacles of the working brackets coincide in their pattern with each other with respect to their relative positions, in particular with respect to their longitudinal axis or median longitudinal plane comprising the longitudinal axis. In this way, the climbing brackets can be anchored after anchoring the working brackets in the anchor holes of the third anchor points of the third concrete wall section through a return stroke movement of the climbing cylinder to the second anchor points of the second concrete wall section and be anchored into the (in the meantime) freed anchor holes of the second anchor points of the second concrete wall section. In the self-climbing system according to the invention and the self-climbing unit according to the invention, the anchor holes of at least a portion of the anchor points are used for anchoring both the working and the climbing brackets. As a result, the number of anchor points or anchor holes required for anchoring the self-climbing unit in the respective concrete wall sections of the concrete building structure can be significantly reduced compared to the self-climbing systems or self-climbing units available on the market. Thus, the number of anchor points or anchor holes can be halved or nearly halved. Only for a respective lowest concrete wall section of the concrete building structure to be constructed are separate anchor points or anchor holes required for the climbing and working brackets. The material and time required for the concrete wall anchor to be brought into the area of the anchor points in the concrete wall sections is further reduced. This offers cost advantages. In addition, the installation expense of the self-climbing system as well as the self-climbing unit is reduced and accelerated. The climbing cylinders allow a floor-by-floor relocation of the self-climbing shuttering, wherein the individual concrete wall sections may have a uniform or different floor height. An external lifting device, such as a crane, is no longer required for the movement of the self-climbing unit on the concrete building structure and in the climbing direction.

According to the invention, the installation expense of the self-climbing unit can be further reduced by the fact that the climbing brackets and working brackets each have (only) two anchor receptacles and each anchor point only two corresponding anchor holes for each anchor bolt. As a result, the risk of structural weakening or damage to the concrete building structure by anchor points can be further reduced. Also, the planning expense can be reduced with respect to the reinforcement to be introduced in the concrete building structure that can collide with the anchor points.

The self-climbing unit may comprise concrete shuttering elements according to the invention. The concrete shuttering elements are carried by the working brackets or supported on them. The concrete shuttering elements allow a successive, in particular floor-by-floor, expansion of the concrete building structure in the vertical direction. Thus, for example, a concrete building structure that functions as a building core or elevator shaft of a house can be extended upward or created using the self-climbing unit.

According to the invention, the working brackets may each have supporting pillars which, at least in sections, extend upward from the working brackets in the vertical or climbing direction during operation of the self-climbing unit. The supporting pillars preferably each have a plurality of attachment points for one of the climbing cylinders that are arranged spaced apart from each other along the supporting pillar. As a result, the climbing cylinders can be posted (fastened) on the supporting pillars with fine graduation. In addition, the aforementioned concrete shuttering elements can be attached, in particular suspended, to the supporting pillars. As a result, both small and large story heights can be created.

The supporting pillars are each designed as a hollow profile according to a preferred further development of the invention. This allows the weight of the self-climbing unit to be minimized. In addition, the supporting pillars can function as a protective cage for the climbing cylinder. If the climbing cylinders each extend into one of the supporting pillars, they are protected without any additional expense against mechanical damage or even excessive soiling with, for example, fresh concrete.

For a simplified attachment, in particular a simplified bolting of the climbing cylinder to the supporting pillars, they are preferably each attached to the climbing brackets with a (small) axial play. The axial play can be in particular up to 15 millimeters.

The lifting or climbing cylinders are preferably each designed as a hydraulic cylinder. Such hydraulic cylinders are durable and inexpensive to manufacture. This makes it possible, on the one hand, to apply the forces required to move the self-climbing unit. On the other hand, hydraulic cylinders allow a sensitive, relatively quiet and thereby rapid movement of the self-climbing unit.

According to the invention, a so-called base platform can be fastened or supported on the climbing brackets for work in the area below the working platform or for safety reasons.

For actuating the hydraulic climbing cylinder according to the invention, a hydraulic pumping device is provided with a control device by means of which the climbing cylinders can be actuated in a synchronized manner.

The hydraulic pumping device preferably has a plurality of pumping units or pumps. According to the invention, each pumping unit can be connected to one or more of the climbing cylinders via a respective fluid valve which can be controlled individually by the control device. The control device preferably has for each hydraulic cylinder a sensor for detecting a respective volume flow of a hydraulic medium to/from the hydraulic cylinder. On the basis of the volume flow, the control device can regulate the (adjustment) speed or the actual extension length of the individual hydraulic climbing cylinders in a precisely synchronized fashion with minimal expense. On the basis of the volume flow of the hydraulic medium detected individually for each climbing cylinder, each climbing cylinder can be controlled individually by the control device in such a way that the climbing cylinders are adjusted (extended/retracted) exactly synchronously with one another during their actuation. Of course, the climbing cylinders used in the construction industry are subject to unavoidable manufacturing tolerances. However, this can be compensated by the volumetric-flow-based control of the climbing cylinder. Thus, a characteristic curve for the dependence between a volume flow of the hydraulic medium and a length adjustment of the climbing cylinder per time unit can be stored in the control device for each climbing cylinder. The characteristic can exist, for example, in electronic form as table values or as an analytical function. The respective characteristic curve of a climbing cylinder can be adjusted if necessary, in particular experimentally, by using an alternative time/distance measurement (scale/distance measurement by laser or by a light barrier system) during the operation of the climbing cylinder.

The self-climbing unit according to the invention is preferably designed as a self-climbing scaffolding unit or as a self-climbing shuttering unit with concrete shuttering elements.

The method according to the invention for vertically moving a self-climbing unit as explained above comprises the following steps:

a. Anchoring the climbing brackets in the anchor holes of the first anchor points of the first concrete wall section with anchor bolts, which engage in the first anchor receptacles of the climbing brackets;
b. Anchoring the working brackets in the anchor holes of the second anchor points of the second concrete wall section by means of anchor bolts which engage in the second anchor receptacles of the working brackets, whereby the first anchor points and the second anchor points are arranged in pairs above each other in the climbing or vertical direction;
c. Releasing the working brackets from the second anchor points of the second concrete wall section;
d. Raising the working brackets from the second anchor points to the third anchor points in the third concrete wall section in the climbing/vertical direction by means of climbing cylinders attached to each one of the climbing brackets and one of the working brackets and anchoring the working brackets in anchor holes of the respective third anchor points by means of the anchor bolts;

e. Releasing the climbing brackets from the first anchor points of the first concrete wall section and raising the climbing brackets in the vertical or climbing direction to the second anchor points of the second concrete wall section by means of the climbing cylinders; and f. Anchoring the climbing brackets in the freed anchor holes of the second anchor points of the second concrete wall section by means of anchor bolts.

It is understood that the method according to the invention necessarily requires the use of the self-climbing unit described above. A climbing process, that is, a movement of the self-climbing unit in the vertical or climbing direction along the concrete building structure can be carried out as a whole with less material, installation and personnel expense. At the same time, the number of required anchor points in the respective concrete wall sections of the finished or yet to be erected concrete building structure and the associated risk of structural weakening of the concrete building structure can be further reduced.

According to a preferred further development of the invention, the self-climbing unit can have concrete wall shuttering elements by means of which the third concrete wall section of the concrete building structure, which abuts the second concrete wall section above the second concrete wall section in the vertical or climbing direction, is created between the aforementioned steps d) and e). In this case, the self-climbing unit is thus used as a self-climbing shuttering unit.

The invention relates to a self-climbing system with a self-climbing unit, in which the climbing brackets and working brackets each have anchor receptacles which correspond with one another in their pattern with respect to their relative positions, with the result that, after freeing the anchor holes, which are used by the working brackets, of an anchor point of a concrete wall section of a concrete building structure, the climbing brackets can be anchored in precisely these freed or available anchor holes of the anchor point. The invention further relates to a self-climbing unit for an aforementioned self-climbing system and a method for moving such a self-climbing unit on a concrete building structure.

BRIEF DESCRIPTION OF THE DRAWINGS

The invention will be explained hereafter in more detail with an exemplary embodiment shown in the drawing.

Shown in the drawings are

DETAILED DESCRIPTION

Figure 1:
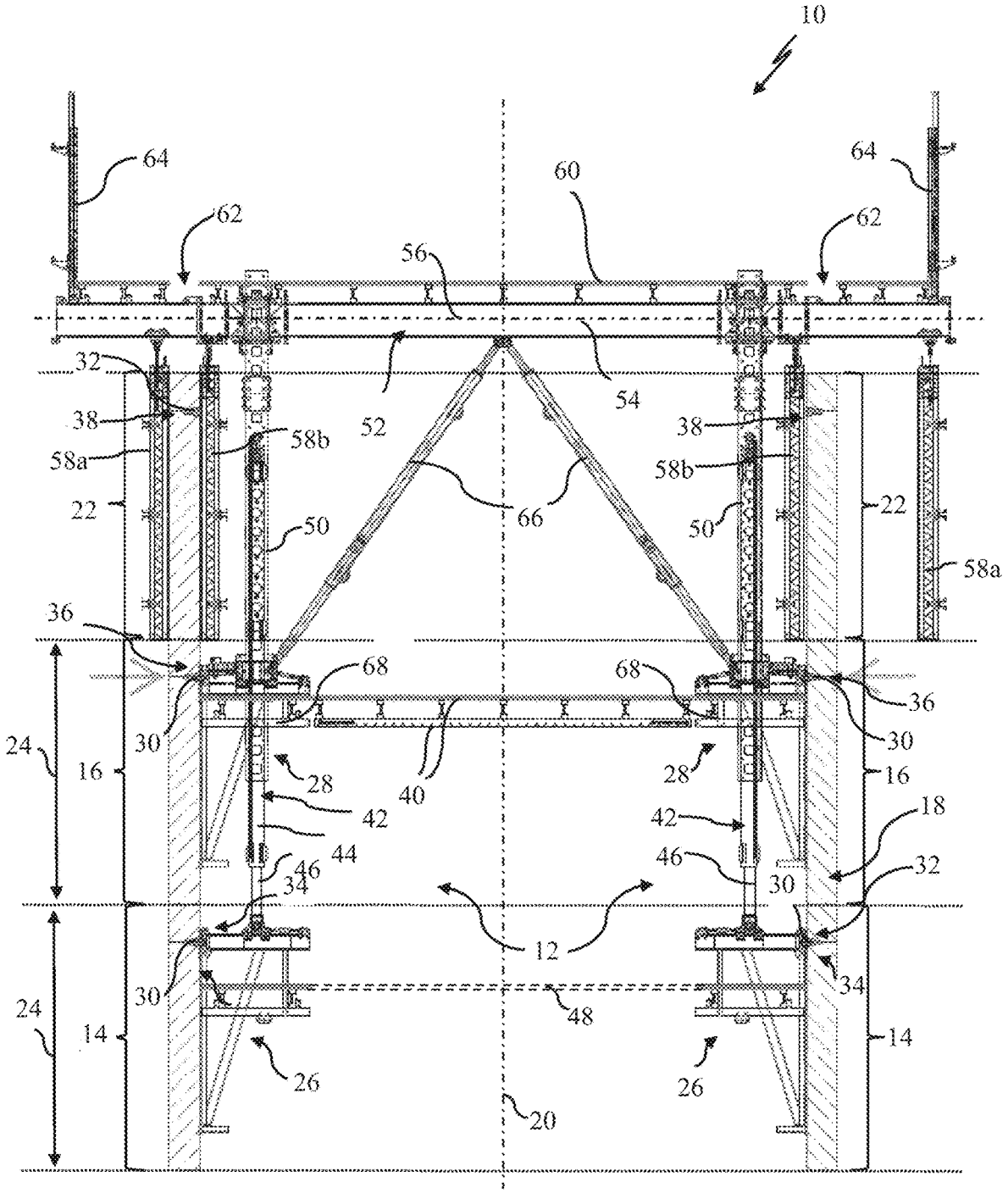
FIG. 1 a self-climbing system having a self-climbing unit with several climbing and working brackets and a working platform, whereby the self-climbing unit can be moved by means of several climbing cylinders on a concrete building structure in the vertical or climbing direction and whereby the climbing brackets are anchored in each of the freed anchor points of the working brackets on the concrete building structure in a partial sectional view.

FIG. 1 shows a self-climbing system 10 having a self-climbing unit 12 that is anchored in this case to a first concrete wall section 14 and to a second concrete wall section 16 of a concrete building structure 18. First concrete wall section 14 and second concrete wall section 16 are arranged one above the other in climbing direction 20, which in this case coincides with the vertical direction, for example. It should be noted that relevant climbing direction 20, such as in the case of construction of retaining walls or the like, can be arranged obliquely to the vertical direction. In the exemplary embodiment depicted in FIG. 1, concrete building structure 18 is to be expanded upward floor-by-floor in the vertical or climbing direction 20 in fresh concrete operations. Shown above second concrete wall section 16 is a third concrete wall section 22 of structure 18 which is to be constructed and which adjoins second concrete wall section 16 in climbing direction 20.

It should be noted that concrete wall sections 14, 16, 22 of concrete building structure 12 can each have a uniform or else a respectively different (story) height 24. Concrete structure 18 may in particular be a so-called building or infrastructure core that is used for the subsequent vertical transportation or technical infrastructure of a building not shown in detail. Such infrastructure cores usually represent the static backbone of buildings and in particular can also form supports for ceilings of the building. Concrete building structure 18 may basically have a polygonal, in particular a rectangular, elliptical or circular cross-sectional shape. A freeform cross-section is also conceivable. In the case of concrete building structure 18 functioning as a building core, each concrete wall section 14, 16, 22 has two wall segments located opposite one another or is (at least partially) closed on three or even four of its sides. In the latter case, the self-climbing unit can be guided or supported on all sides on the concrete wall sections of concrete building structure 18.

Self-climbing unit 12 comprises according to FIG. 1 several so-called climbing brackets 26 and several so-called working brackets 28. Climbing brackets 26 are preferably of identical design. Working brackets 28 are preferably also of identical design. Climbing and working brackets may have different designs due to their different functionality.

Climbing brackets 26 are releasably anchored by anchor bolts 30 in anchor holes 32 of first anchor points 34 of first concrete wall section 14. Working brackets 28 are releasably anchored by anchor bolts 30 in anchor holes 32 of second anchor points 36 of second concrete wall section 16.

First and second anchor points 34, 36 of two concrete wall sections 14, 16 are arranged with their anchor holes 32 in vertical or climbing direction 20 in pairs to each other one above the other and are aligned to each other. In each case a third anchor point 38 of third concrete wall section 22 is arranged in alignment with its anchor holes 32 in climbing/vertical direction 20 to one of first anchor points 34 and one of second anchor points 36 of first and second concrete wall section 14, 16.

The self-climbing unit comprises an accessible first working platform 40, which is attached and supported on working brackets 26. Platform 40 is also referred to in the construction sector as so-called "Level 0".

Self-climbing unit 12 can be moved by means of several climbing cylinders 42 without the use of a crane in vertical direction 20 along concrete wall sections 14, 16, 22. Climbing cylinders 42 may be designed in particular as hydraulic cylinders and then in the usual way each have a cylinder 44 and a fluid-actuated piston 46 guided within cylinder 44 that can be hydraulically extended from cylinder 44 and retracted into cylinder 44.

Climbing cylinders 42 are attached at one end to one of the working brackets 28 and at the other end, in this case to the free end of its piston 46, to one of climbing brackets 26 arranged underneath.

A so-called base platform 48 may be attached to climbing brackets 26. Base platform 48 is shown in FIG. 1 by a dashed line. A supporting pillar 50 may be arranged on each of working brackets 28. In this case, supporting pillars 50 preferably extend upward from associated working brackets 28, at least in sections, in vertical or climbing direction 20. A support frame 52 is attached to the upper end of supporting pillars 50. Support frame 52 includes a plurality of crossbeams 54 which are interconnected. It is understood that support frame 52 is matched in its shape and its design to the cross-sectional shape of concrete building structure 18. In the direction of a transverse axis 56, which extends orthogonally to vertical direction 20, support frame 52 protrudes outwardly in the shape of a gallows in the radial direction over first and second concrete wall sections 14, 16.

Self-climbing unit 12 is designed as a self-climbing shuttering and has a plurality of concrete shuttering elements 58*a*, 58*b*. By means of the concrete shuttering elements, third concrete wall section 22 was created by the method of fresh concrete casting. Shuttering elements 58 are attached to supporting pillar 52 and can in particular be suspended on it. In each case two of shuttering elements 58*a*, 58*b* are arranged opposite each other in the radial direction. Shuttering elements 58*a*, 58*b* are preferably mounted displaceably in the direction of transverse axis 56 on support frame 52 of self-climbing unit 12 in order to shutter the concrete wall sections to be produced in climbing direction 20 above third concrete wall section 22 and to be able to strip the shuttering again after its completion. In addition, due to the displaceable mounting of shuttering elements 58*a*, 58*b*, different wall thicknesses (=wall strengths) can be set in the respective concreting sections at minimal expense.

A working platform 60 may be arranged on support frame 52. Working platform 60 is thus arranged in the operational use of self-climbing unit 12 above working platform 40. This working platform is commonly referred to in the construction industry as "Level+1". Working platform 60 preferably has through-holes (=discharge openings) 62 for introducing fresh concrete between shuttering elements 58*a*, 58*b*. Discharge openings 62 can be closed if necessary. Working platform 60 is provided on the edge side with a railing 64 for fall protection. Support frame 52 may be supported by additional support struts 66 on working brackets 28.

For weight reasons, supporting pillars 50 are each designed as a hollow profile and can extend downward and upward from a working platform seat 68 of respective working bracket 28 in vertical direction 20. In self-climbing unit 12 shown in FIG. 1, climbing cylinders 42 each extend in the axial direction into one of supporting pillars 50. Support columns 50 thereby function as a protective cage for climbing cylinder 42. Climbing cylinders 42 are thus largely protected against mechanical damage from the outside or from contamination.

Working brackets 28 can be moved after completion of third concrete wall section 22 by means of a synchronized feed motion of climbing cylinder 42 in climbing direction 20 of second anchor points 36 of second concrete wall section 16 to third anchor points 38 of third concrete wall portion 22 of concrete building structure 18.

Figure 2:
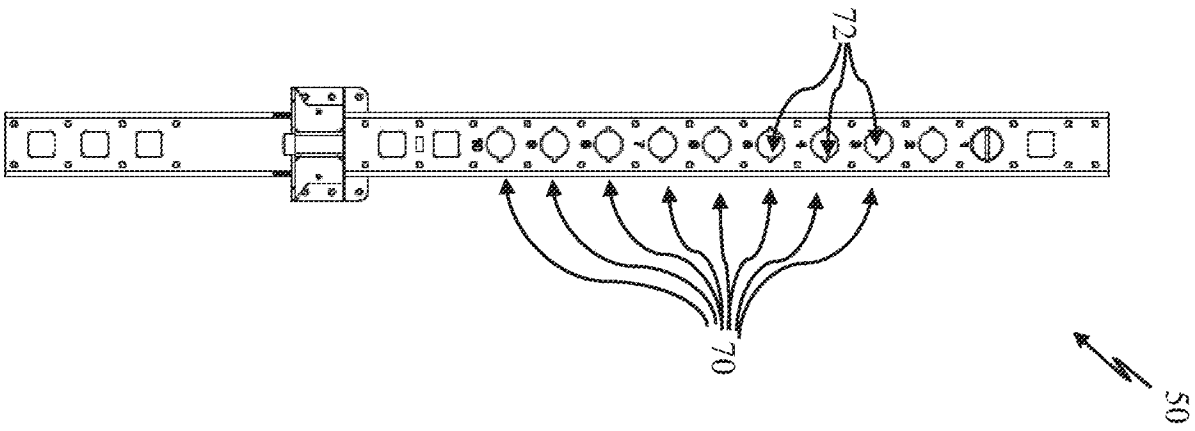
FIG. 2 a supporting pillar of a working bracket of the self-climbing unit according to FIG. 1 in a side view.

In FIG. 2 an example of one of supporting pillars 50 of self-climbing unit 12 from FIG. 1 is shown. Supporting pillars 50 have a plurality of attachment points 70 for climbing cylinders 42 that are arranged along supporting pillars 50 and are spaced apart from each other. Attachment points 70 of supporting pillar 50 for climbing cylinder 42 include through-openings 72 on at least two oppositely arranged sides of the supporting pillar. Through-holes 72 are arranged in alignment to each other in pairs in the radial direction. A climbing cylinder 42 can be bolted to supporting pillar 50 via through-holes 72, meaning it can be fixed in place in the axial direction on supporting pillar 50. Climbing cylinders 42 are preferably attached at the other end to the climbing bracket, each with a small axial clearance (0.5 cm-2 cm), so that climbing cylinder 42 at respective attachment point 70 of respective supporting pillar 50 can be more easily staked/bolted.

Figure 3:
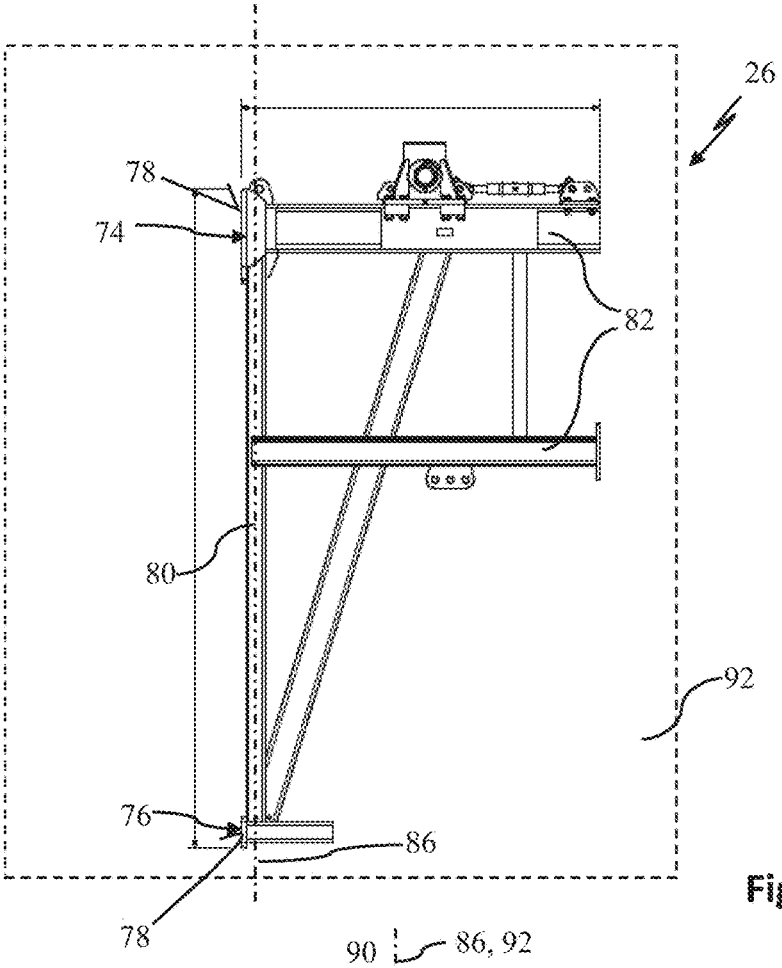
FIG. 3 a climbing bracket of the self-climbing unit according to FIG. 1 in a side view.
Figure 4:
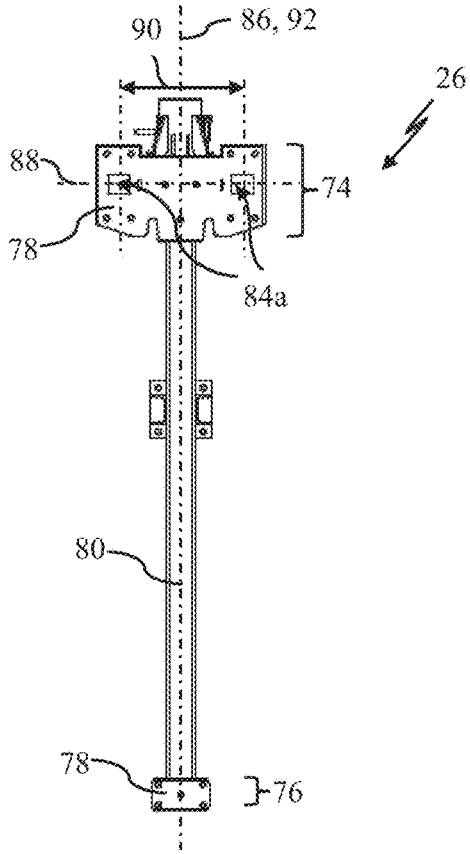
FIG. 4 the climbing bracket according to FIG. 3 in a frontal view.

FIG. 3 shows an exemplary embodiment of climbing bracket 26 of self-climbing unit 12 from FIG. 1 in an exposed side view and in FIG. 4 shown in a frontal view.

Climbing bracket 26 has an upper wall shoe section 74 and a lower support portion 76, each having a contact surface 78 for a respective concrete wall section 14, 16, 22 (i.e., its vertical viewing surface). Wall shoe section 74 serves to anchor climbing bracket 26 to one of respective concrete wall sections 14, 16, 22. Support section 76 essentially serves as a horizontally directed support of working bracket 28 on respective concrete wall section 14, 16, 22. Wall shoe section 74 and support section 76 are interconnected via a longitudinal profile 80. Cantilever beams 82 are used to attach the base platform or a climbing cylinder (FIG. 1).

Climbing bracket 26 has two first anchor receptacles 84*a* for anchor bolts 30 (FIG. 1). First anchor receptacles 84*a* can each be formed as through-holes of wall shoe section 74. Anchor receptacles 84*a* are arranged as shown in FIG. 4 on a transverse axis 88 that runs orthogonal to bracket longitudinal axis 86 and is spaced apart from it at a distance 90. The two first anchor receptacles 84*a* are arranged here in mirror symmetry with respect to a longitudinal center plane 92 of climbing bracket 26 that encompasses the bracket longitudinal axis and is oriented orthogonally to contact surfaces 78.

Climbing bracket 26 in the installed state on one of concrete wall sections 14, 16, 22 of concrete building structure 18 (FIG. 1) that is vertically oriented here, for example, is vertically aligned or essentially vertically aligned with its bracket longitudinal axis 84 in a manner corresponding to concrete wall sections 14, 16, 22. As a result, transverse axis 88 is arranged in the installed state of climbing bracket 26 horizontally or substantially horizontally.

Figure 5:
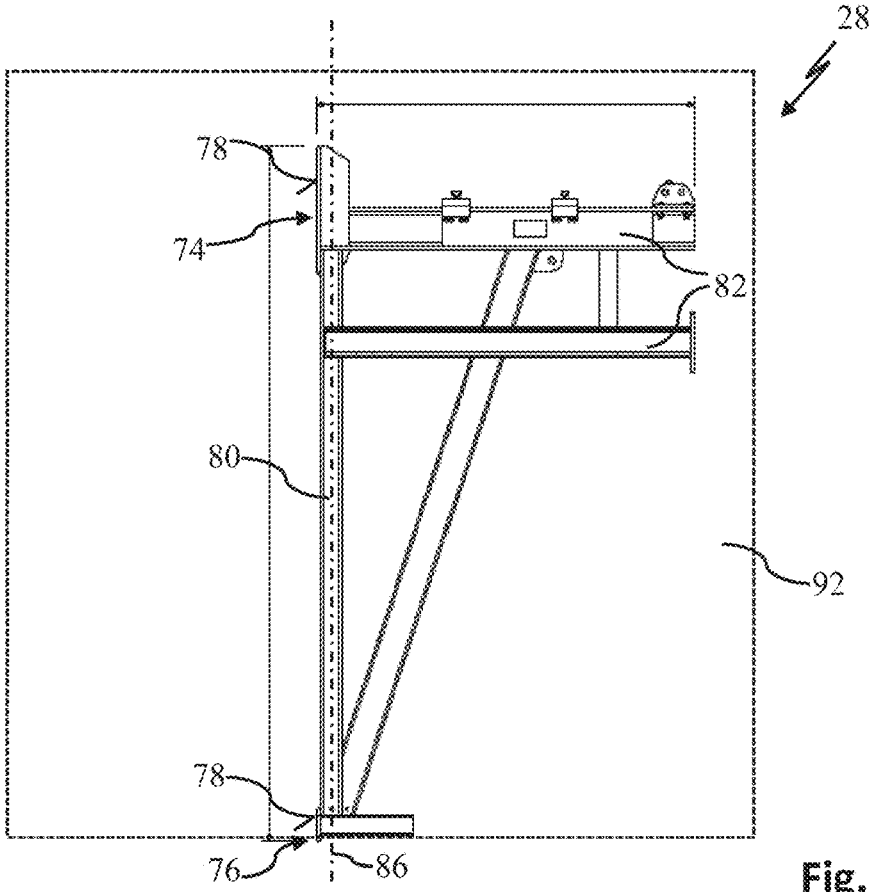
FIG. 5 a working bracket of the self-climbing unit according to FIG. 1 in a side view.
Figure 6:
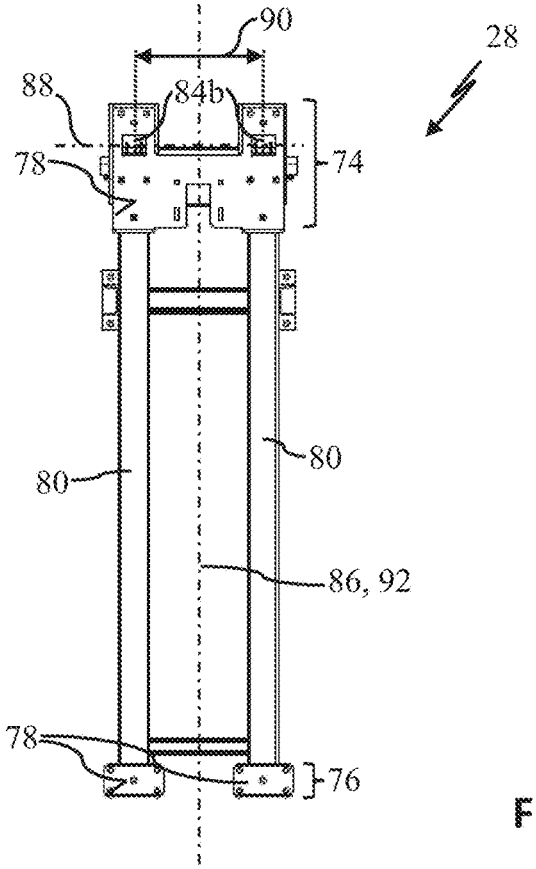
FIG. 6 the working bracket of FIG. 5 in a frontal view.

FIG. 5 shows a working bracket 28 of the self-climbing unit 12 shown in FIG. 1 in an exposed side view and in FIG. 6 in an end view. Working bracket 28, in a manner corresponding to climbing brackets 26 shown in FIGS. 3 and 4, has an upper wall shoe section 74 and a bottom support section 76, each of which are provided with contact surfaces 78 for a respective concrete wall section 14, 16, 22 (i.e., its vertical viewing surface). Wall shoe section 74 and support section 76 are connected to each other purely via two longitudinal profiles 80 as an example. Cantilever beams 82 serve to support working platform 40 or one of supporting pillars 50 (FIG. 1).

Working bracket 28 has, analogously to working bracket 26, two second anchor receptacles 84*b* for anchor bolts 30 (FIG. 1). Second anchor receptacles 84*b* are arranged at a distance 90 from each other on transverse axis 88 of climbing bracket 26 that runs orthogonally to bracket longitudinal axis 86. The two second anchor receptacles 84*b* are arranged mirror-symmetrically with respect to a longitudinal axis 92 of climbing bracket 26 that encompasses bracket longitudinal axis 86 and is oriented orthogonally to contact surfaces 78 of climbing bracket 26. Working bracket 28 has in the assembled state on one of concrete wall sections 14, 16, 22 a bracket longitudinal axis 86 that extends in this case vertically or essentially vertically in the direction of climbing direction 20. As a result, transverse axis 88 is arranged horizontally or essentially horizontally in the installed state of climbing bracket 26.

Second anchor receptacles 84*b* of working brackets 28 and first anchor receptacles 84*a* of climbing brackets 26 correspond with one another in their pattern with respect to their relative positions on their respective wall shoe part.

Figure 7:
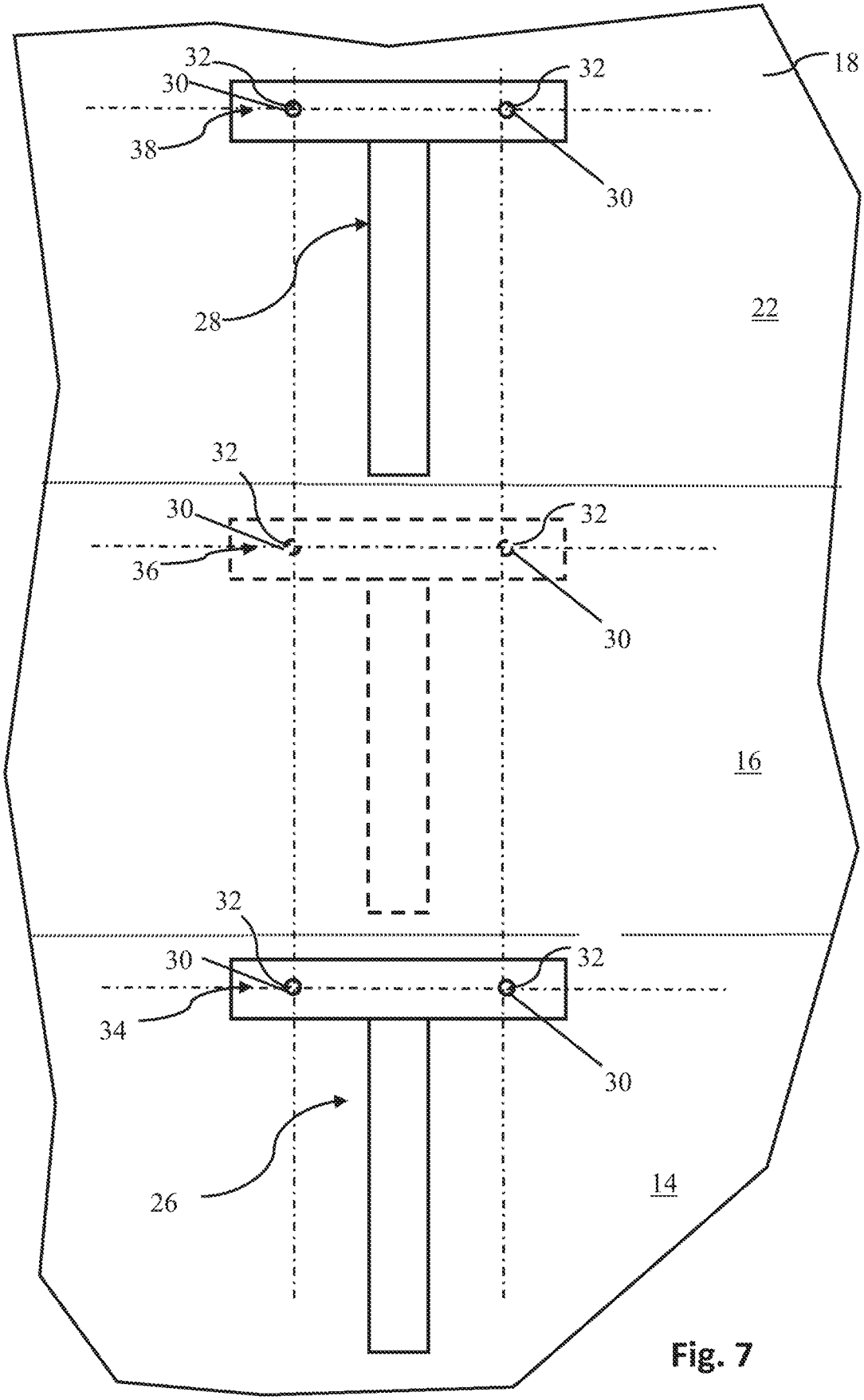
FIG. 7 concrete wall sections of the concrete building structure of FIG. 1 with a climbing bracket and with a working bracket in a very schematically rendered front view.

In FIG. 7, first and the second concrete wall section 14, 16 and third concrete wall section 22 of concrete building structure 18 are shown after its completion (curing) in segments and together with climbing bracket 26 and working bracket 28. Climbing bracket 26 and working bracket 28 are rendered very schematically.

Anchor points 34, 36, 38 of concrete wall sections 14, 16, 22 situated one over the other each have two anchor holes 32 for anchor bolts 30 in a way corresponding to anchor receptacles 84*a*, 84*b* of working bracket 28 and climbing bracket 26 that correspond with one another in their patterns with respect to their relative positions as well as also respectively with the relative position of anchor receptacles 84*a*, 84*b* of climbing bracket 26 and working bracket 28 on wall shoe parts 74.

Thus, in each case one anchor hole 32 of anchor point 34 of first concrete wall section 14, one anchor hole 32 of second anchor point 36 of second concrete wall section 14 and one anchor hole 32 of third anchor point 38 of third concrete wall section 22 and one anchor hole of each further overlying anchor point of any further concrete wall section in climbing direction 20 are aligned with each other.

As a result, climbing bracket 26 anchored in first anchor point 34 of first concrete wall section 14 after being raised to anchor holes 32 of third anchor points 38 of third concrete wall section by a return stroke movement (=retraction of pistons 46 into cylinders 44) of climbing cylinders 42 is moved to second anchor points 36 of second concrete wall section 16 and anchored in the anchor holes 32 of second anchor points 32 of second concrete wall section 16 that are being freed.

Figure 8:
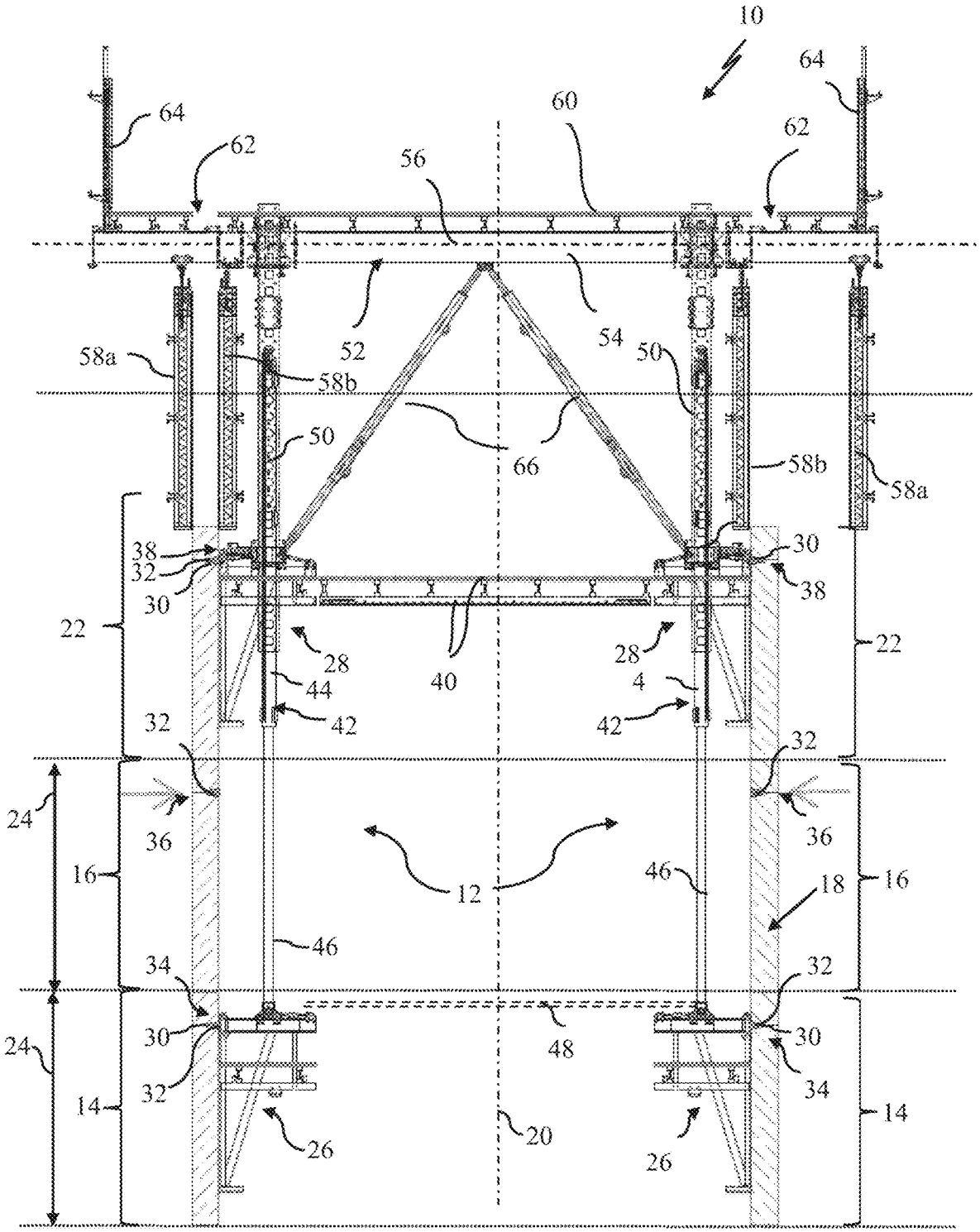
FIG. 8 the self-climbing system according to FIG. 1 after raising and re-anchoring the working brackets on the concrete building structure in a partial sectional view.
Figure 9:
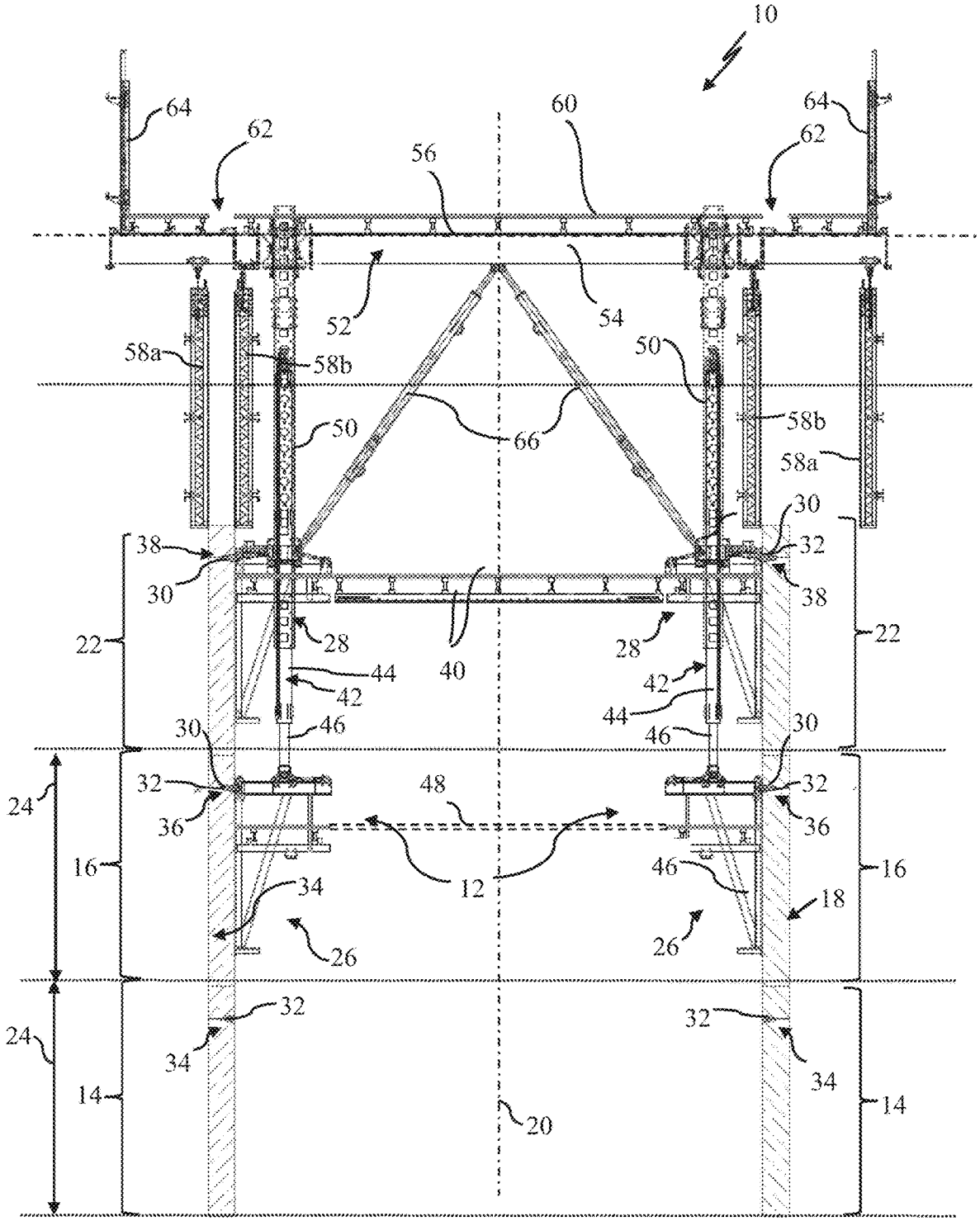
FIG. 9 the self-climbing system according to FIG. 1 after a complete story-by-story movement of the self-climbing unit on the concrete building structure in the vertical or climbing direction in a partial sectional view.

In FIGS. 8 and 9, the self-climbing unit from FIG. 1 is shown in two successive phases of a climbing or movement process. According to FIG. 8, working brackets 28 have been released from their anchoring to second anchor points 36 of second concrete wall section 16 and moved upward to third anchor points 38 of finished (hardened) third concrete wall section 22 by means of a feed motion of climbing cylinder 42 in vertical or climbing direction 20. Working brackets 28 are anchored by means of anchor bolts 30 in anchor holes 32 of third anchor points 38. The climbing cylinders are dimensioned in such a way so that they are able to span two full story heights 24 of the concrete wall sections. A corresponding static design of the climbing cylinder is therefore indispensable.

According to the illustration of the self-climbing system in FIG. 9, climbing brackets 26 were released from their anchoring in anchor holes 30 of first anchor points 34 of first concrete wall section 14 and moved by a return stroke movement of climbing cylinders 42 to second anchor points 36 of second concrete wall section 16. Climbing brackets 26 are anchored in freed anchor holes 30 of second anchor points 36 of second concrete wall section 16 and each have two anchor bolts 30, which engage in first anchor receptacles 84*a* of climbing brackets 26. Concrete shuttering elements 58*a*, 58*b* of self-climbing unit 12 are then available for enclosing a further, here fourth concrete, wall section, which directly adjoins third concrete wall section 22 above third concrete wall section 22 in climbing direction 20.

In the self-climbing system according to the invention, the same anchor holes of the anchor points of concrete wall sections of a concrete building structure positioned one over the other can thus be used alternately for the working brackets and for the climbing brackets.

Figure 10:
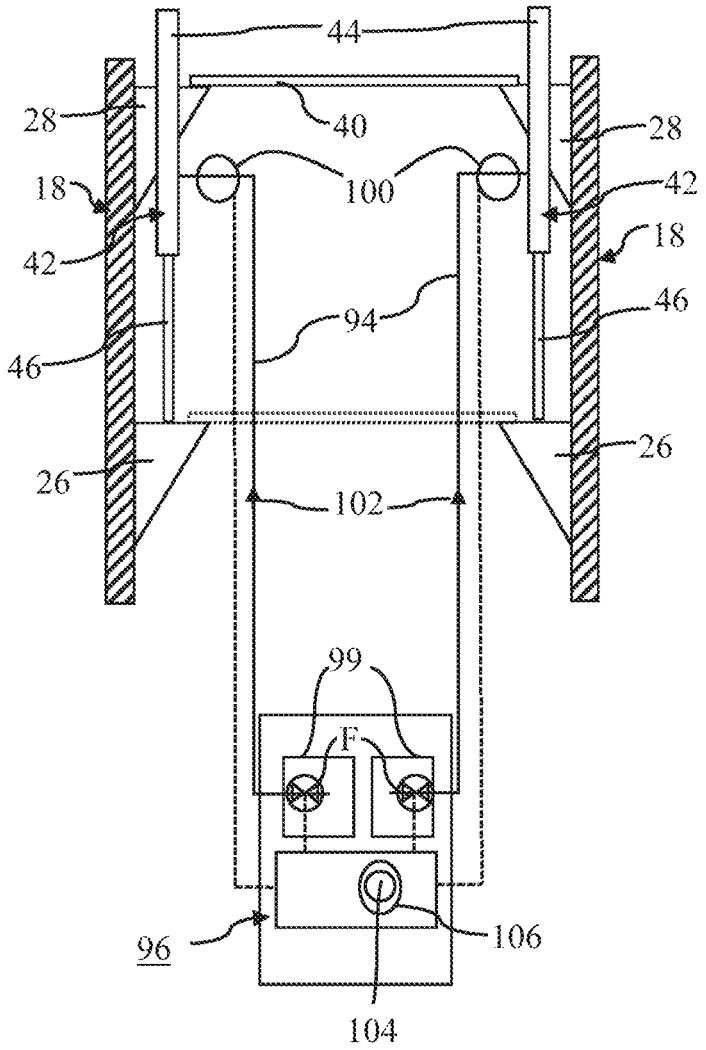
FIG. 10 a block diagram of a self-climbing unit of FIG. 1.

FIG. 10 shows a block diagram of the above-explained self-climbing unit 12. Climbing cylinders 42 are each connected via a plurality of hydraulic lines 94 to hydraulic pumping device 96. The hydraulic pumping device has control device 98 for actuating individual pumping units 99 (pumps) of hydraulic pumping device 96. Each pumping unit 99 may serve the operation of climbing cylinder 42 or, if necessary, a plurality of climbing cylinders 42. It is understood that pump units 99 in the latter case have at least one fluid valve F that is controllable by control device 98 for each climbing cylinder 42 that is fluidly connected to pumping unit 99. As a result, in this case as well, the volume flow of the hydraulic medium can be regulated individually for each individual climbing cylinder. During movement of self-climbing unit 12, which may have several dozen of the shown climbing cylinders, working brackets 28 must be positioned with their second anchor receptacles 84*b* or climbing brackets 16 with their first anchor receptacles 84*a* all as accurately as possible in front of the predetermined anchor holes 32 of respective anchor points 34, 36, 38*th* of respective concrete wall section 14, 16, 22. Control device 100 can therefore have a sensor 100 for each climbing cylinder 42 to detect a respective volume flow 102 of a hydraulic medium for the actuation of climbing cylinder 42. Sensors 100 may also be arranged in the housing of the control device designated as 98. On the basis of the individually detected volume flow of the hydraulic medium, each hydraulic cylinder 42 can be controlled individually by control device 98, such that the climbing cylinders are moved (are extended/retracted) exactly synchronously with one another during their actuation. Climbing cylinders 42 of self-climbing unit 12 are naturally subjected to unavoidable manufacturing tolerances and are subject to varying degrees of wear and tear. In control device 98, for each climbing cylinder 42 an individual characteristic curve 104 can therefore be stored for the dependency between a volume flow of the hydraulic medium and an associated actual length adjustment of climbing cylinder 42 per time unit. The characteristic 104 can exist, for example, in electronic form as table values or as an analytical function. It is understood that control device 98 must have a CPU (not shown) as well as suitable storage medium 106 for storing characteristic curve 104.

The above-explained self-climbing unit 12 is formed as a self-climbing shuttering unit. Self-climbing unit 12 can also be used in the construction industry without the shown concrete shuttering elements 58*a*, 58*b*, i.e. in the form of a self-climbing scaffolding unit. Concrete building structure 18 can then be, for example, a finished building core, for instance in its raw construction state.

Figure 11:
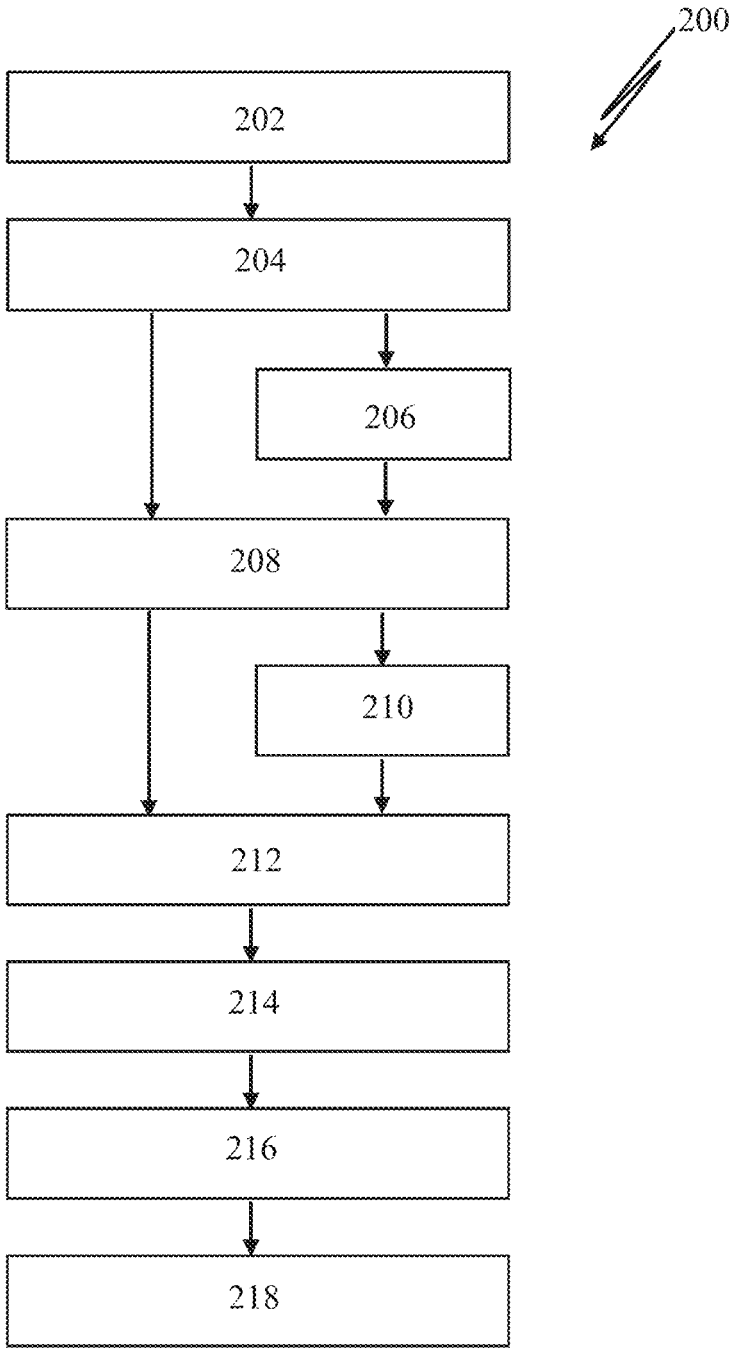
FIG. 11 a diagrammatic representation of a method for moving a self-climbing unit according to FIG. 1.

Inventive method 200 for moving above-explained self-climbing unit 12 will be explained below with reference to FIG. 11. In first step 202, climbing brackets 26 are anchored with anchor bolts 30 in anchor holes 32 of first anchor points 34 of first concrete wall section 14.

Each anchor bolt 30 engages in one of second anchor receptacles 84*b* of climbing brackets 26.

In further step 204, working brackets 28 are anchored with anchor bolts 30 in anchor holes 32 of second anchor points 36 of second concrete wall section 16. Anchor bolts 30 in each case engage in one of anchor receptacles 84*b* of working brackets 28 shown in FIG. 6.

In further step 206, climbing cylinders 42 are attached to each one of the climbing and working brackets 26, 28 arranged in pairs in climbing direction 20 and in this case, for example, also vertically one over the other, if this has not yet been done. Climbing cylinders 42 are preferably inserted from above into supporting pillars 50 of respective working brackets 28.

In a further step 208, working platform 40 and/or working platform 60 is attached to working brackets 28.

In subsequent optional step 210, the third concrete wall section to be constructed can be shuttered with the shuttering elements of the self-climbing unit and subsequently produced via the fresh concrete method.

To move the self-climbing unit, working brackets 28 are released in further step 212 from second anchor points 36 of second concrete wall section 16 by the respective anchor bolts 30 being removed from anchor holes 30 of second anchor points 36. Working brackets 28, along with working platform 60 arranged on them and concrete shuttering elements 58*a*, 58*b*, are now carried solely by climbing cylinders 42, which are supported at the base on at least one of climbing brackets 26.

In further step 214, working brackets 28 are moved (raised) by means of a controlled feed motion which is actuated by controlling device 98 of hydraulic pumping device 96 of climbing cylinder 42 from second anchor points 36 to third anchor points 38 of third concrete wall section 22 in climbing direction 20, and working brackets 28 are anchored in anchor holes 32 of respective third anchor points 38 by means of anchor bolt 30.

In further step 216, climbing brackets 26 are released from first anchor points 34 of first concrete wall section 14. Climbing brackets 26 as well as optionally attached trailing platform 48 of self-climbing unit 12 are held on the working brackets at this instant solely via climbing cylinder 42.

In concluding step 218, climbing brackets 26 are moved (raised) in climbing direction 20 by means of a return stroke movement of climbing cylinders 42 from first anchor points 34 of first concrete wall section 14 to second anchor points 36 of second concrete wall section 16 and subsequently are anchored by means of anchor bolts 30 into freed anchor holes 32 of second anchor points 36 of second concrete wall section 16.

Self-climbing unit 12 can hereinafter be used for concreting a further concrete wall section, which adjoins third concrete wall section 22 in climbing direction 20 above third concrete wall section 22.

The invention claimed is:

1. A self-climbing system, comprising:

a first plurality of brackets, each of the first plurality of brackets defining first anchor receptacles configured to receive an anchor bolt such that the first plurality of brackets are releasably anchorable in a first plurality of anchor holes of first anchor points;

a second plurality of brackets, each of the second plurality of brackets defining second anchor receptacles configured to receive an anchor bolt such that the second plurality of brackets are releasably anchorable in a second plurality of anchor holes of second anchor points;

a plurality of hydraulic cylinders attached at one end to the first plurality of brackets such that the first plurality of brackets are movable by the plurality of hydraulic cylinders; and a hydraulic pump device having a control device configured to approximately synchronously actuate the plurality of hydraulic cylinders.

2. The system of claim 1, further comprising a support frame configured to support at least one shuttering element, wherein the at least one shuttering element is displaceably mounted with respect to the support frame such that the at least one shuttering element is displaceable relative to a transverse axis of the support frame.

3. The system of claim 1, wherein the hydraulic pumping device comprises a plurality of the pumping units, each pumping unit being connected to at least one hydraulic cylinder.

4. The system of claim 3, wherein each pumping unit is connected to at least one hydraulic cylinder via a fluid valve that is individually controllable by the control device.

5. The system of claim 4, wherein a number of fluid valves of each pumping unit corresponds to at least a number of hydraulic cylinders that are respectively connected to the pumping unit.

6. The system of claim 1, wherein a sensor is arranged in a housing of the control device.

7. The system of claim 6, wherein a flow volume of the hydraulic medium for each of the plurality of hydraulic cylinders is detected.

8. The system of claim 7, wherein the control device synchronously actuates the hydraulic cylinders based upon an individual characteristic curve for each of the plurality of hydraulic cylinders, wherein each individual characteristic curve associates a volume flow of hydraulic medium and a length adjustment of each of the plurality of hydraulic cylinders.

9. The system of claim 1, wherein the first anchor points are positioned at a first concrete wall section and the second anchor points are positioned at a second concrete wall section.

10. The system of claim 9, wherein at least one of the first anchor points of the first concrete wall section and one of the second anchor points of the second concrete wall section are aligned with each other in a climbing direction.

11. The system of claim 1, further comprising a first platform attachable to the first plurality of brackets.

12. The system of claim 11, wherein the first plurality of brackets are movable by the plurality of hydraulic cylinders from the first anchor points to the second anchor points and are configured to be anchored in second plurality of anchor holes of the second anchor points of the second concrete wall section.

13. The system of claim 1, further comprising a second platform attachable to the second plurality of brackets.

14. The system of claim 1, wherein the control device has a sensor for each hydraulic cylinder.

15. The system of claim 14, wherein the sensor for each hydraulic cylinder is configured to detect a respective volume flow of a hydraulic medium to and/or from the plurality of hydraulic cylinders.

16. The system of claim 1, wherein the first plurality of anchor holes comprises a pair of anchor holes.

17. A self-climbing system, comprising:

a first plurality of brackets, each of the first plurality of brackets defining first anchor receptacles configured to receive an anchor bolt such that the first plurality of brackets are releasably anchorable in a first plurality of anchor holes of first anchor points;

a second plurality of brackets, each of the second plurality of brackets defining second anchor receptacles configured to receive an anchor bolt such that the second plurality of brackets are releasably anchorable in a second plurality of anchor holes of second anchor points;

a plurality of hydraulic cylinders attached at one end to the first plurality of brackets such that the first plurality of brackets are movable by the plurality of hydraulic cylinders; and at least one supporting pillar defining a plurality of attachment points along the climbing direction such that at least one of the plurality of hydraulic cylinders is fastenable to the at least one supporting pillar, wherein at least a part of the at least one supporting pillar defines a hollow profile.

18. The system of claim 17, wherein at least a portion of the at least one hydraulic cylinder extends into the at least one supporting pillar.

19. The system of claim 17, wherein at least one of the first anchor points of the first concrete wall section and one of the second anchor points of the second concrete wall section are aligned with each other in a climbing direction.

20. A self-climbing system, comprising:

a first plurality of brackets, each of the first plurality of brackets defining first anchor receptacles configured to receive an anchor bolt such that the first plurality of brackets are releasably anchorable in a first plurality of anchor holes of first anchor points;

a second plurality of brackets, each of the second plurality of brackets defining second anchor receptacles configured to receive an anchor bolt such that the second plurality of brackets are releasably anchorable in a second plurality of anchor holes of second anchor points;

a plurality of hydraulic cylinders attached at one end to the first plurality of brackets such that the first plurality of brackets are movable by the plurality of hydraulic cylinders; and at least one supporting pillar defining a plurality of attachment points along the climbing direction such that one of the plurality of hydraulic cylinders is fastenable to the at least one supporting pillar and a portion of one of the plurality of hydraulic cylinders extends into the at least one supporting pillar.

* * * * *